US006415716B1

(12) United States Patent
Sanford et al.

(10) Patent No.: US 6,415,716 B1
(45) Date of Patent: Jul. 9, 2002

(54) LINE CHARGE ASSEMBLY AND SYSTEM FOR USE IN SHALLOW-WATER CLEARING OPERATIONS

(75) Inventors: Matthew J. Sanford, Bel Alton, MD (US); Keith B. Lewis, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/784,202

(22) Filed: Feb. 16, 2001

(51) Int. Cl.[7] ..... F42B 33/06; F42B 22/42

(52) U.S. Cl. ..... 102/302; 102/402; 102/403; 102/224

(58) Field of Search ..... 102/302, 402, 102/403, 223, 224

(56) References Cited

U.S. PATENT DOCUMENTS

| | | | | | |
|---|---|---|---|---|---|
| 2,262,445 | A | * | 11/1941 | Alford | 102/302 |
| 3,169,480 | A | | 2/1965 | Seavey | 102/27 |
| 3,460,477 | A | | 8/1969 | Heideman et al. | 102/27 |
| 4,311,097 | A | | 1/1982 | Backstein et al. | 102/229 |
| 4,395,951 | A | | 8/1983 | Hinely et al. | 102/223 |
| 4,423,682 | A | | 1/1984 | Schimmel | 102/275.2 |
| 4,542,694 | A | | 9/1985 | Wells | 102/229 |
| 4,658,726 | A | * | 4/1987 | Held | 102/223 X |
| 4,854,239 | A | | 8/1989 | Van Sloun | 102/426 |
| 4,938,136 | A | * | 7/1990 | Gould | 102/402 X |
| 4,989,516 | A | | 2/1991 | Silvia | 102/275.9 |
| 5,437,230 | A | * | 8/1995 | Harris et al. | 102/302 |
| 5,546,862 | A | * | 8/1996 | Schabdach | 102/302 |
| 5,675,104 | A | * | 10/1997 | Schorr et al. | 89/1.11 X |
| 5,821,447 | A | | 10/1998 | Reams et al. | 102/223 |
| 6,101,916 | A | * | 8/2000 | Panot et al. | 102/402 X |
| 6,182,553 | B1 | * | 2/2001 | Peterson | 102/403 |
| 6,286,431 | B1 | * | 9/2001 | Cangelosi | 102/402 |

OTHER PUBLICATIONS

US 6,308,633, 10/2001, Grosch et al. (withdrawn)*.

* cited by examiner

*Primary Examiner*—Peter A. Nelson
(74) *Attorney, Agent, or Firm*—James B. Bechtel, Esq.; Peter J. Van Bergen, Esq.

(57) ABSTRACT

A line charge assembly and system are provided for use in a shallow-water obstruction clearing operation. Each assembly has a propulsion unit capable of flight through the air, a line charge array, an air-safed water-armed fuze, and at least one explosive diode. The line charge array is defined by a plurality of line charges successively coupled to one another by a line capable of transferring detonation energy thereallong successively to each of the line charges. One end of the line charge array is coupled to the propulsion unit and the other end is coupled to the fuze. The fuze is capable of generating the detonation energy only when in water. The explosive diode is positioned in the line charge array to limit transfer of the detonation energy in a direction of propagation running from the fuze to the propulsion unit. The system utilizes a plurality of the line charge assemblies deployed over an area. If a line charge assembly has a dud fuze, the explosive diode prevents the back propagation of sympathetic detonation energy to any of the assembly's line charges that reside between the dud fuze and explosive diode.

24 Claims, 3 Drawing Sheets

LINE CHARGE ASSEMBLY AND SYSTEM FOR USE IN SHALLOW-WATER CLEARING OPERATIONS

ORIGIN OF THE INVENTION

The invention described herein was made in the performance of official duties by employees of the Department of the Navy and may be manufactured, used, licensed by or for the Government for any governmental purpose without payment of any royalties thereon.

CROSS-REFERENCE TO RELATED PATENT APPLICATIONS

This patent application is co-pending with one related patent application entitled "LINE CHARGE ASSEMBLY AND SYSTEM FOR USE IN SHALLOW-WATER CLEARING OPERATIONS" (Navy Case No. 82564), by the same inventors as this patent application.

FIELD OF THE INVENTION

The invention relates generally to systems for clearing mines and other obstructions from a shallow-water area, and more particularly to a line charge assembly and system used to clear a shallow-water area that is automatically disabled after a prescribed period of time during which detonation does not occur and that is equipped to prevent sympathetic detonation of any of such assemblies having a dud fuze.

BACKGROUND OF THE INVENTION

Surf zone mine clearing operations involve the placement of a large number of charges over an area that will define a safe lane of travel for follow-up traffic. Ideally, these charges are placed from a safe stand-off distance, are reliably detonated, and rendered inoperable if they do not detonate. One system being considered for these operations is a line charge assembly that is launched from a watercraft into a surf zone. A number of such assemblies would be deployed and then detonated to clear mines and other obstructions from an area. Following detonation, another set of line charge assemblies would be deployed in an area adjacent to the just-cleared area. To ensure total clearing, the area to be cleared is defined to partially overlap the area just cleared. However, this system presents two substantial problems.

The first problem is inherent to any explosive system. That is, each line charge assembly must be fuzed to prevent its unintended detonation during shipping, storage and deployment. Further, the fuze must initiate detonation only at a specified time and in specified conditions, and is still further required (by a variety of ordinance guidelines and standards) to disable any possible detonation after the specified time period has lapsed. Thus, the fuze must be "safed" if it is a dud where "safed" means that the fuze's primary energetic components cannot transfer detonation energy to the fuze's explosive train that contains less energetic materials.

The second problem is one brought about by the nature of the above-described operation. Specifically, when a watercraft is to deploy line charge assemblies in an area that is adjacent to a just-cleared area, the watercraft may have to enter the just-cleared area in order to deploy its line charge assemblies in the proper overlap zone. If there is (are) "dud" fuze(s) in the just-cleared area, the deploying watercraft could be positioned over undetonated line charges when in the overlap zone. Accordingly, it is imperative that the undetonated line charges by prevented from sympathetic detonation in the overlap zone even when a line charge assembly's fuze is a dud.

SUMMARY OF THE INVENTION

Accordingly, it is an object of the present invention to provide a line charge assembly and system for use in shallow-water obstruction clearing operations.

Another object of the present invention is to provide a line charge assembly that can be reliably detonated in accordance with specified conditions.

Still another object of the present invention is to provide a line charge assembly that is reliably "safed" in its pre-use condition and in its dud condition.

Yet another object of the present invention is to provide a line charge assembly and system that is equipped to prevent sympathetic detonation of line charges in at least a portion of the line charge when the line charge assembly's fuze is a dud.

Other objects and advantages of the present invention will become more obvious hereinafter in the specification and drawings.

In accordance with the present invention, a line charge assembly and system are provided for use in a shallow-water obstruction clearing operation. Each assembly has a propulsion unit capable of flight through the air, a line charge array, an air-safed water-armed fuze, and at least one explosive diode. The propulsion unit is used to pull the line charge array, the explosive diode and fuzz through the air to a water destination. The line charge array is defined by a plurality of line charges successively coupled to one another by a line capable of transferring detonation energy therealong successively to each of the line charges. The line charge array has a first end coupled to the propulsion unit and a second end coupled to the fuze. The fuze is capable of generating the detonation energy only when in water. The explosive diode is in line with the line between the first and second ends of the line charge array. The explosive diode is positioned to limit transfer of the detonation energy in a direction of propagation defined by the second end to the first end of the line charge array. In use, a plurality of the line charge assemblies are deployed and detonated in an area. The explosive diodes prevent the back propagation of sympathetic detonation energy to any of the assembly's line charges that reside between it's fuze and explosive diode in the case where the fuze is a dud.

The fuze generates the detonation energy for the line charge array only under certain conditions. The specific three conditions required for the generation of the detonation energy are deployment of line charge assembly, the lapse of specified time period after deployment, and the immersion of the fuze in water. If the deployment condition is not met, the fuze remains in a safe mode. If the deployment condition is met, but the water condition is not met by the expiration of the specified time period, the fuze remains in the safe mode and is further equipped to automatically sterilize itself to forever prevent the generation of detonation energy. If all conditions are met, the fuze generates detonation energy and supplies same to the aft end of the line charge array. The detonation energy propagates along the detonation line from the direction of the fuze towards the propulsion unit to successively detonate the line charges.

DETAILED DESCRIPTION OF THE INVENTION

Figure 1:
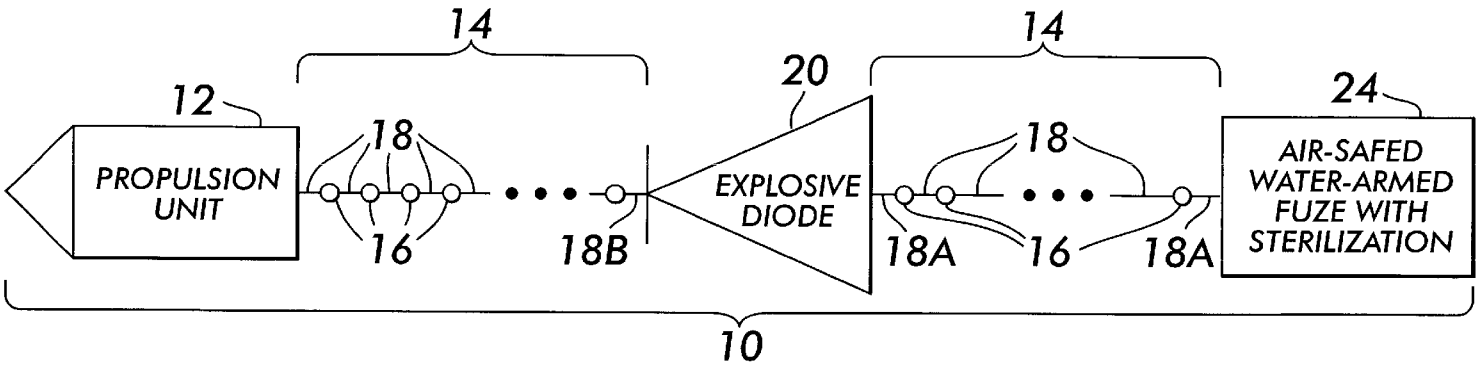
FIG. 1 is a schematic representation of a line charge assembly according to the present invention.

Referring now to the drawings, and more particularly to FIG. 1, a line charge assembly according to the present invention is shown and referenced generally by numeral 10. Line charge assembly 10 is shown in its deployed state. That is, prior to deployment, line charge assembly 10 is stored in a container (not shown) and launched therefrom. The container is transported to its deployment destination by a surface ship (not shown) as will be explained further below.

Line charge assembly 10 includes a propulsion unit 12 which typically is a rocket. Tethered to propulsion unit 12 is a line charge array 14 consisting of a plurality of line charges 16 successively tethered to one another by a detonation cord or line 18. Line charges 16 are any explosive device that uses non-primary energetic explosive material requiring a high energy event for initiation. The necessary high energy event is transferred along detonation line 18 as will be explained further below. That is, detonation line 18 is representative of any coupling mechanism that can tether two successive line charges 16 to one another and transfer detonation energy therealong. The particular choices for line charges 16 and detonation line 18 are not limitations of the present invention. In addition, although not shown for clarity of illustration, line charges 16 will be mechanically tethered to one another by a strong lightweight material/cord such as a nylon web cord as is well known in the art.

Disposed in line charge array 14 between two successive line charges 16 is an explosive diode 20. More specifically, explosive diode 20 couples detonation line segment 18A to detonation line segment 18B, and will only permit propagation of detonation energy from segment 18A to segment 18B while blocking the transfer of detonation energy from segment 18B to segment 18A. Such explosive diodes are known in the art and are available commercially from, for example, Teledyne McCormick-Selph Inc., Hollister, Calif. By way of illustrative example, only one explosive diode 20 is shown in line charge array 14. However, additional explosive diodes can be positioned in line charge array 14 for reasons that will be explained further below.

Tethered to the aft end of line charge array 14 is an air-safed water-armed fuze 24 that generates the detonation energy for line charge array 14 only under certain conditions. The specific three conditions required for the generation of the detonation energy are deployment of line charge assembly 10 (i.e., propulsion unit 12 has been launched into the air and is pulling line charge array 14, explosive diode 20 and fuze 24 through the air), the lapse of specified time period after deployment, and the immersion of fuze 24 in water. If the deployment condition is not met, fuze 24 remains in a safe mode. If the deployment condition is met, but the water condition is not met by the expiration of the specified time period, fuze 24 remains in the safe mode and is further equipped to automatically sterilize itself to forever prevent the generation of detonation energy. If all conditions are met, fuze 24 generates detonation energy and supplies same to the aft end of line charge array 14. The detonation energy propagates along detonation line 18 (from fuze 24 towards propulsion unit 12) to successively detonate line charges 16.

The use of line charge assembly 10 in a system for clearing a shallow-water area of obstructions (e.g., mines, underwater debris, underwater foliage, etc.) will now be explained with the aid of FIG. 2. In general, the clearing operation is designed to open a lane of unobstructed travel through a shallow-water area 100 to a beach 102. The method for accomplishing such lane clearing proceeds generally as follows. Since shallow-water area 100 frequently extends out from beach 102 for great distances, the clearing of a lane is typically done in segments. Accordingly, each of a set of line charge assemblies 10 are deployed and detonated over a relatively small area to be cleared. After the covered area's line charge assemblies 10 are detonated in the water, another set are deployed over a next sequential area. To insure adequate clearing of obstructions, each area to be cleared should partially overlap the previously cleared area. This process continues from a point out in the open water up to beach 102.

Figure 2:
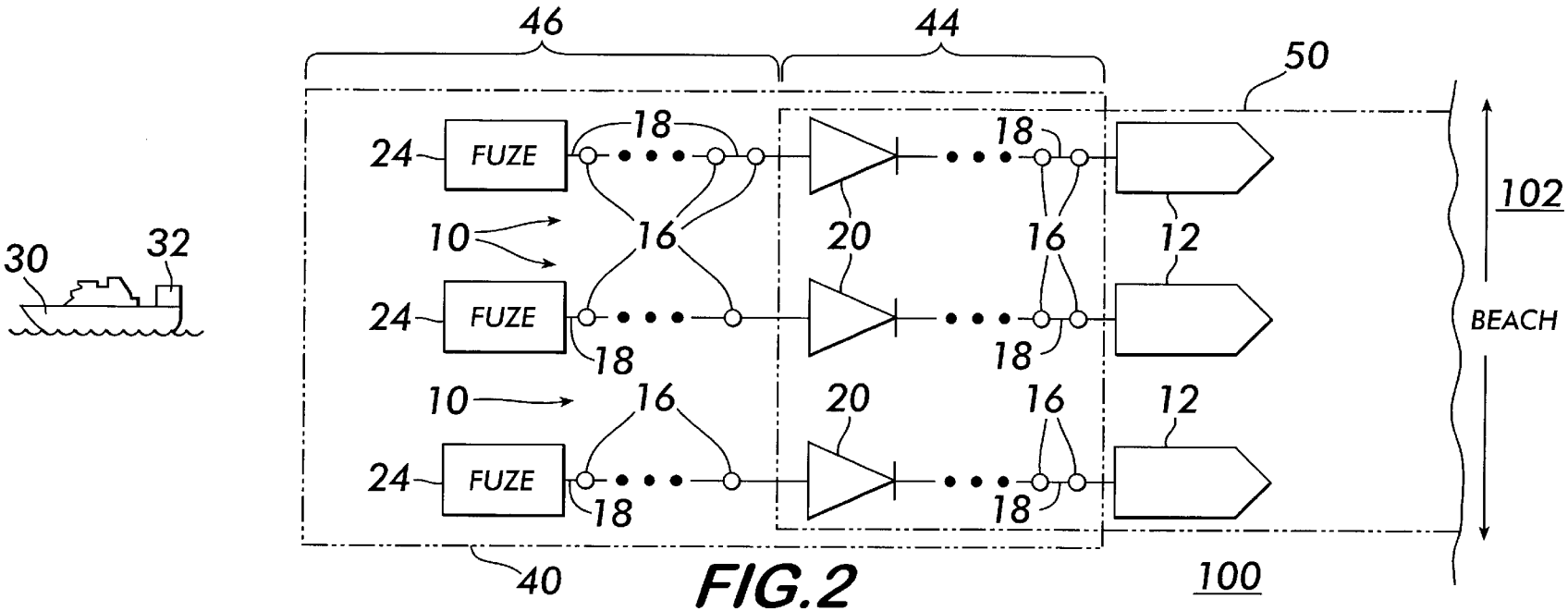
FIG. 2 is a schematic view of a line charge system and deployment scenario using a plurality of line charge assemblies according to the present invention.

Referring now more specifically to FIG. 2, an example of the above-described general process will be explained. A watercraft 30 transports a plurality of the above-described line charge assemblies 10 in a container 32 to shallow-water area 100. Each of the line charge assemblies can be launched individually and on-command from container 32. Such launching techniques and systems therefor are well known in the art and will not be described further herein. Each line charge assembly's fuze 24 is configured to detonate once in the water. After such detonation, another of the line charge assemblies is deployed/detonated at a location in area 40 that is adjacent to the most recently detonated line charge assembly. Note that if a particular line charge assembly does not detonate because of a dud fuze, the process of deploying additional line charge assemblies continues as if detonation occurred while the undetonated line charge assembly remains in place in the water.

FIG. 2 depicts a scenario where a plurality of line charge assemblies 10 have been deployed in an area defined by dotted lines 40. For purpose of illustration, the line charge assemblies 10 are illustrated as if they had not been detonated in order to show their relative pre-detonation relationship to one another in area 40. However, in practice, each of the line charge assemblies is detonated before the next adjacent one is deployed. Through the use of well known aiming and launching techniques, line charge assemblies 10 are deployed in an approximately side-by-side fashion such that the positions of explosive diodes 20 are arrayed across area 40 at known locations thereby defining a portion 46 of area 40 which will be explained further below.

Once deployed in water as shown, each of assemblies 10 should detonate automatically thereby leaving area 40 clear of all line charges 16 and, ideally, any obstructions in area 40. As mentioned above, to insure a successful clearing operation, watercraft 30 launches its next set of line charge assemblies (not shown) into a next successive area (represented by dashed lines 50) that partially overlaps area 40 at an overlap area 44. The amount of overlap is a design choice and is not a limitation of the present invention. However, the amount of overlap desired does determine the relative position of explosive diode 20 in line charge array 14.

As mentioned above, explosive diode 20 only permits the transfer of detonation energy in a direction of propagation that runs from fuze 24 towards propulsion unit 12. In other words, the detonation energy for each successive line charge 16 must come from the direction of fuze 24. If denotation energy was somehow supplied to any of line charges 16 between explosive diode 20 and propulsion unit 12 without coming through explosive diode 20, such detonation energy would not pass through explosive diode 20, i.e., from segment 18B to segment 18A.

The importance of explosive diode 20 is that it provides a safety factor for watercraft 30 when it is time to position itself for deployment of the next set of line charge assemblies, i.e., into area 50 in the illustrative example. In order to properly place the line charge assemblies, it may be necessary for watercraft 30 to position itself in some portion 46 of area 40 that is adjacent area 50. However, if one (or more) fuze 24 deployed in area 40 is a dud, watercraft 30 is at risk of being positioned over undetonated line charges 16. The risk to watercraft 30 is not due to a dud fuze 24 as it is sterilized (as will be explained further below) prior to the entry of watercraft 30 into area 46. Such sterilization prevents the subsequent transfer of detonation energy from the dud fuze 24 to it's line charges 16 in area 46. Instead, the risk to watercraft 30 is that some high energy event occurring in area 44 will set off a line charge 16 in area 44 and cause the propagation of resulitng detonation energy back toward area 46. The purpose of explosive diode 20 is to prevent detonation energy from the sympathetic detonation of any of line charges 16 in overlap area 44 from propagating back into area 46 which could jeopardize watercraft 30 during the deployment of line charge assemblies in area 50.

Figure 3:
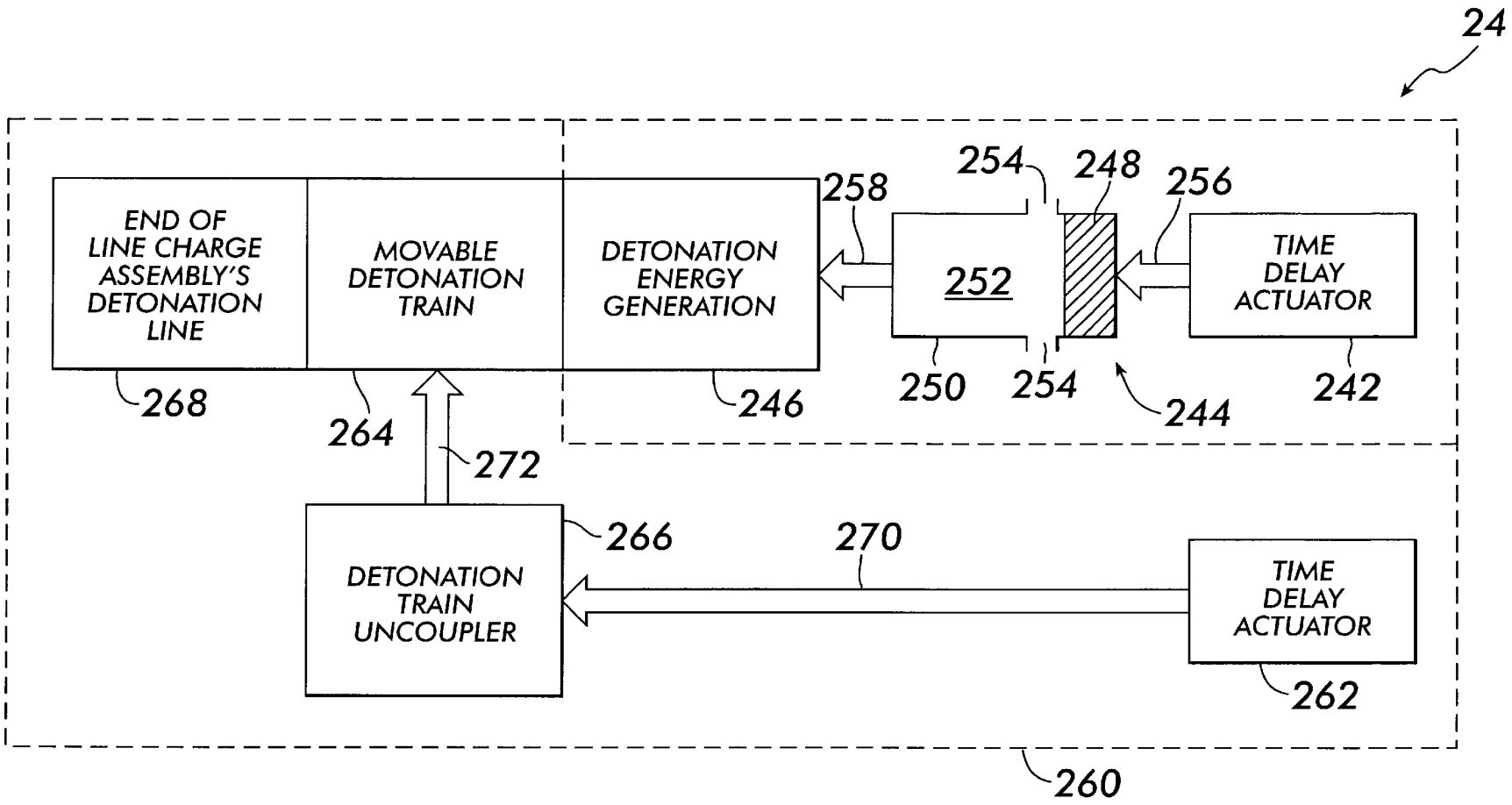
FIG. 3 is a schematic view of one embodiment of an air-safed water-armed fuze used in each line charge assembly.

An embodiment of fuze 24 will now be described generally with the aid of FIG. 3. Fuze 24 has a detonation energy generator portion contained within dashed line box 240 and a detonation energy coupler/decoupler portion contained within dashed line box 260. Detonation energy generator portion 240 has a time delay actuator 242, a piston assembly 244 and a detonator energy generation block 246. Piston assembly 244 has a piston 248 slidably fitted in a cylinder 250 at one end thereof to define a chamber 252 therein. Chamber 252 is provided with one or more vents 254 that allow chamber 252 to communicate, i.e., fill, with fluid (not shown) from a surrounding fluid environment, i.e., air or water. Detonation energy coupler/decoupler portion 260 includes a time delay actuator 262, a movable detonator train 264, a detonation train uncoupler 266 coupled between actuator 262 and movable detonation train 264, and the end 268 of the detonation line (i.e., line 18) of a line charge assembly of the present invention.

In operation, fuze 24 will begin its flight through the air when its line charge assembly is deployed under the power of its propulsion unit as described above. When the flight of fuze 24 commences, each of time delay actuators 242 and 262 is initiated to begin its time delay function. For reasons that will be clearer below, time delay actuator 262 has a longer time delay than that of actuator 242. Accordingly, the function of detonation energy generator portion 240 will first be described. At the conclusion of actuator 242's time period, actuator 242 generates an actuating force 256 applied to piston 248 thereby causing piston 248 to move in cylinder 250 and seal off vents 254. Continued movement of piston 248 compresses the fluid in chamber 252. Such compression translates into another actuating force 258. The size of force 258 depends on the fluid in chamber 252. Specifically, if chamber 252 is filled with air, force 252 is very small owing to the air's compressibility. However, if chamber 252 is filled with water (as it would be when fuze 24 enters the water), force 258 is much greater owing to the incompressibility of water. Detonation energy generation block 246 is designed to be sensitive/responsive only to the greater amount of force 258, i.e., when chamber 252 is filled with water. In such a case, block 246 generates detonation energy which is passed to end 268 of the line charge assembly's detonation line via movable detonation train 264. After enough time has passed for the above functions to occur, e.g., a few seconds, time delay actuator 262 times out and generates an actuating force 270 that is applied to detonation train uncoupler 266. Uncoupler 266 essentially translates force 270 to a mechanical force 272 that moves detonation train 264 out of alignment with end 268 thereby sterilizing fuze 24. Accordingly, after actuator 262 has timed out and the above operations are complete, any subsequent operation of detonation energy generation block 246 could not be transferred to end 268.

Figure 4:
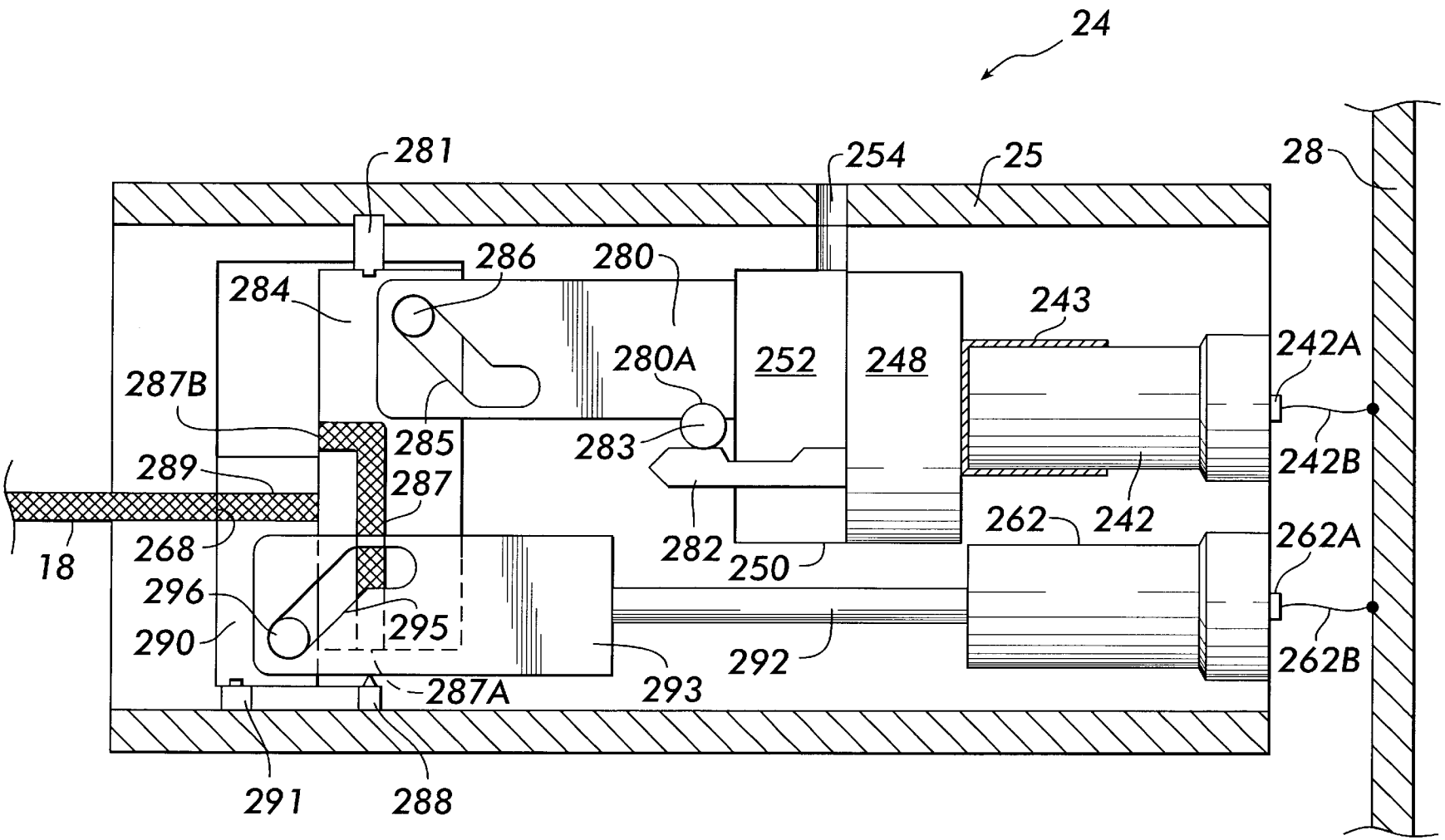
FIG. 4 is a cutaway view of a specific implementation of the fuze.

A specific implementation for carrying out the functions of fuze 24 will be described by way of example with the aid of FIG. 4 where like reference numerals will be used where appropriate. It is to be understood that only the essential structural features of fuze 24 are depicted for clarity of illustration. A housing 25 supports and protects the various elements of fuze 24. Each of time delay actuators 242 and 262 are mounted in housing 25 and can be realized by small column insulated delays (SCIDs) that produce a gas output at the conclusion of their time delay period. SCIDs of this type are available commercially from Teledyne McCormick-Selph Inc., Hollister, Calif. Typically, as is known in the art, each of SCID-type actuators 242 and 262 has an initiating shaft 242A and 262A, respectively, that initiates the time delay action when the shaft is pulled out and allowed to snap back. Accordingly, each of shafts 242A and 262A has a short lanyard 242B and 262B coupled thereto and attached to, for example, a wall 28 of a launch tube (not shown). When fuze 24 is pulled away from wall 28 during deployment, shafts 242A and 262A are pulled until lanyards 242B and 262B break, at which point shafts 242A and 262A snap back.

At the conclusion of the time delay of actuator 242, a gas output is generated and supplied to a small chamber 243 in communication with piston 248. Piston 248 operates in cylinder 250 as described above. Chamber 252 communicates with an arming piston 280 held in position by a shear pin 281 and by a piston locking mechanism to prevent inadvertent movement of piston 280 at all times except when actuator 242 times out and fuze 24 is in water. The locking mechanism can be realized by a locking arm 282 extending from piston 248 and alongside piston 280. Piston 280 is provided with a notch 280A receiving a ball lock 283 as positioned by locking arm 282. When piston 248 is driven through cylinder 250, locking arm 282 advances and allows ball lock 283 to disengage from piston 280. During this time, piston 280 is free to be acted on by the force generated in chamber 252. If chamber 252 is filled with water, the force acting on piston 280 is sufficient to break shear pin 281 thereby allowing piston 280 to move to the left in the figure. If chamber 252 is filled with air, the force acting on piston 28 is insufficient to break shear pin 281. Further, piston 248 will continue to move to the left thereby causing locking arm 282 to again press ball lock 283 into notch 280A and again safe fuze 24.

Assuming chamber 252 is filled with water so that piston 280 moves to the left, fuze 24 proceeds to generate detonation energy as follows. Piston 280 is coupled to a slider block 284 by means of a slot 285 in piston 280 and a post 286 extending from block 284 into slot 285. Leftward movement of piston 280 causes transverse movement of block 284.

Disposed in slider block 284 is a run 287 of energetic material that will detonate upon impact. Run 287 is shaped to transfer detonation energy along run 287 to other portions of a detonation train that transfer detonation energy to the line charge array of the present invention. The necessary impact to initiate run 287 is brought about by the above-described transverse movement of block 284. Specifically, the transverse sliding movement causes one end 287A of run 287 to impact a firing pin 288. Simultaneously, such movement positions the other end 287B of run 287 in line with a coupling detonation train 289 mounted in a second sliding block 290. Sliding block 290 is held in position (until fuze 24 undergoes sterilization) by a shear pin 291. Coupling detonation train 289 is aligned with end 268 of the line charge assembly's detonation line 18. As a result, when the proper conditions exist, detonation energy generated in run 287 transfers to coupling detonation train 289 and then to end 268.

If run 287 has not been initiated before actuator 262 times out, the following events take place. The gas output of actuator 262 is supplied through a chamber 292 to a piston 293. Piston 293 is coupled to slider block 290 by means of a slot 295 in piston 293 and a post 296 extending from block 290 into slot 295. The gas output of actuator 262 provides a sufficient force on piston 293 to break shear pin 291 and allow leftward movement of piston 293. Such leftward movement of piston 293 causes transverse sliding movement of block 290 thereby knocking coupling detonation train 289 out of alignment with end 268 to sterilize fuze 24.

The advantages of the present invention are numerous. The line charge assembly and system provide a safe and reliable means for clearing a path through a surf zone. The particular arrangement of elements is ideally suited for the Navy's current design approach for lane clearing operations. The use of an explosive diode in each line charge array will prevent the back propagation of detonation energy in a sympathetic detonation scenario. The unique air-safe water-armed fuze with sterilization provides a high degree of detonation reliability along with safing and sterilization mechanisms to prevent both inadvertent and late detonation problems.

Although the invention has been described relative to a specific embodiment thereof, there are numerous variations and modifications that will be readily apparent to those skilled in the art in light of the above teachings. For example, each line charge array could have more than one explosive diode mounted in line therewith. In this way, each line charge assembly could be used in a variety of different deployment overlap scenarios (i.e., more or less overlap) to provide a greater degree of flexibility for a given application. One example where this would be of value is where adjacent areas to be cleared are at an angle with respect to one another as is the case when a lane to be cleared must be curved. When meeting at an angle, one side of an overlap area will be larger than the other side of the overlap area. It is therefore to be understood that, within the scope of the appended claims, the invention may be practiced other than as specifically described.

What is claimed as new and desired to be secured by Letters Patent of the United States is:

1. A line charge assembly for use in a shallow-water obstruction clearing operation, comprising;

a propulsion unit capable of flight through the air;

a line charge array defined by a plurality of line charges successively coupled to one another by a line capable of transferring detonation energy therealong successively to each of said plurality of line charges, said line charge array having a first end coupled to said propulsion unit and having a second end;

an air-safed water-armed fuze coupled to said second end for generating said detonation energy only when in water; and at least one explosive diode in line with said line between said first end and said second end and positioned to limit transfer of said detonation energy in a direction of propagation defined by said second end to said first end, wherein said propulsion unit pulls said line charge array, said at least one explosive diode and said fuze through the air to a water destination.

2. A line charge assembly as in claim 1 wherein said propulsion unit is a rocket.

3. A line charge assembly as in claim 1 wherein said air-safed water-armed fuze comprises:

first means for generating said detonation energy when first conditions exists, said first conditions defined by said fuze being underwater at the expiration of a first time period, said first time period commencing when said fuze begins to be pulled by said propulsion unit; and second means coupled between said first means and said second end for permitting transfer of said detonation energy to said second end when said first conditions exist and for preventing transfer of said detonation energy to said second end when second conditions exist, said second conditions defined by said detonation energy having not been generated at the expiration of said first time period and the expiration of a second time period, wherein said second time period is longer than said first time period.

4. A line charge assembly as in claim 3 wherein said first means comprises:

a housing;

a cylinder defined in said housing;

a piston slidably mounted in said cylinder wherein a chamber is defined on one side of said piston, said chamber having at least one vent communicating with a surrounding fluid environment wherein said chamber is filled with fluid from said surrounding fluid environment;

a first time delay actuator for providing a first actuating force to said piston at the expiration of said first time period wherein said piston slides in said cylinder, seals said at least one vent and acts on said fluid in said chamber; and detonation means coupled to said chamber and responsive to movement of said piston to generate said detonation energy only when said fluid is water.

5. A line charge assembly as in claim 4 wherein said second means comprises:

a second time delay actuator for generating a second actuating force at the expiration of said second time period; and detonation coupling means coupled between said detonation means and said second end for permitting transfer of said detonation energy to said second end when said first conditions exist, said detonation coupling means coupled to said second time delay actuator and responsive to said second actuating force to prevent transfer of said detonation energy to said second end when said second conditions exist.

6. A line charge assembly as in claim 5 wherein said detonation means comprises:

a second piston mounted in said housing for sliding movement therein, said second piston having a piston face exposed to said chamber wherein said second piston undergoes sliding movement when said first conditions exist;

a first block slidingly mounted in said housing and coupled to said second piston, wherein said sliding movement of said second piston causes a transverse sliding movement of said first block;

a first portion of a detonation train disposed in said first block; and a firing pin mounted in said housing for striking said first portion of said detonation train when said first block undergoes said transverse sliding movement, wherein said first portion of said detonation train is initiated to generate said detonation energy.

7. A line charge assembly as in claim 6 wherein said detonation coupling means comprises:

a third piston mounted in said housing for sliding movement therein, said third piston having a piston face coupled to said second time delay actuator for receiving said second actuating force and for undergoing sliding movement in response thereto;

a second block mounted in said housing and coupled to said third piston, wherein said sliding movement of said third piston causes a transverse sliding movement of said second block;

a second portion of said detonation train disposed in said second block;

a third portion of said detonation train disposed in said housing and coupled to said second end of said line charge array; and said second block being positioned such that said second portion and said third portion of said detonation train are adjacent and aligned with one another prior to the expiration of said second time period wherein said transverse sliding movement of said second block causes said second portion of said detonation train to move out of alignment with said third portion of said detonation train.

8. A line charge assembly as in claim 5 further comprising means coupled to said first time delay actuator and said second time delay actuator for simultaneously actuating said first time delay actuator and said second time delay actuator, wherein said first time period and said second time period commence simultaneously.

9. A line charge system for use in a shallow-water obstruction clearing operation, comprising;

a deployment watercraft;

a plurality of line charge assemblies maintained onboard said deployment watercraft for deployment therefrom, each of said plurality of line charge assemblies comprising a propulsion unit capable of flight through the air;

a line charge array defined by a plurality of line charges successively coupled to one another by a line capable of transferring detonation energy therealong successively to each of said plurality of line charges, said line charge array having a first end coupled to said propulsion unit and having a second end;

an air-safed water-armed fuze coupled to said second end for generating said detonation energy only when in water; and an explosive diode in line with said line between said first end and said second end and positioned to limit transfer of said detonation energy in a direction of propagation defined by said second end to said first end, wherein said propulsion unit pulls said line charge array, said explosive diode and said fuze through the air to a water destination and wherein, when said plurality of said line charge assemblies are deployed side-by-side over an area, a plurality of explosive diodes from said plurality of line charge assemblies are arrayed across said area.

10. A line charge system as in claim 9 wherein said propulsion unit is a rocket.

11. A line charge system as in claim 9 wherein said air-safed water-armed fuze comprises:

first means for generating said detonation energy when first conditions exists, said first conditions defined by said fuze being underwater at the expiration of a first time period, said first time period commencing when said fuze begins to be pulled by said propulsion unit; and second means coupled between said first means and said second end for permitting transfer of said detonation energy to said second end when said first conditions exist and for preventing transfer of said detonation energy to said second end when second conditions exist, said second conditions defined by said detonation energy having not been generated at the expiration of said first time period and the expiration of a second time period, wherein said second time period is longer than said first time period.

12. A line charge system as in claim 11 wherein said first means comprises:

a housing;

a cylinder defined in said housing;

a piston slidably mounted in said cylinder wherein a chamber is defined on one side of said piston, said chamber having at least one vent communicating with a surrounding fluid environment wherein said chamber is filled with fluid from said surrounding fluid environment;

a first time delay actuator for providing a first actuating force to said piston at the expiration of said first time period wherein said piston slides in said cylinder, seals said at least one vent and acts on said fluid in said chamber; and detonation means coupled to said chamber and responsive to movement of said piston to generate said detonation energy only when said fluid is water.

13. A line charge system as in claim 12 wherein said second means comprises:

a second time delay actuator for generating a second actuating force at the expiration of said second time period; and detonation coupling means coupled between said detonation means and said second end for permitting transfer of said detonation energy to said second end when said first conditions exist, said detonation coupling means coupled to said second time delay actuator and responsive to said second actuating force to prevent transfer of said detonation energy to said second end when said second conditions exist.

14. A line charge system as in claim 13 wherein said detonation means comprises:

a second piston mounted in said housing for sliding movement therein, said second piston having a piston face exposed to said chamber wherein said second piston undergoes sliding movement when said first conditions exist;

a first block slidingly mounted in said housing and coupled to said second piston, wherein said sliding movement of said second piston causes a transverse sliding movement of said first block;

a first portion of a detonation train disposed in said first block; and a firing pin mounted in said housing for striking said first portion of said detonation train when said first block undergoes said transverse sliding movement, wherein said first portion of said detonation train is initiated to generate said detonation energy.

15. A line charge system as in claim 14 wherein said detonation coupling means comprises:

a third piston mounted in said housing for sliding movement therein, said third piston having a piston face coupled to said second time delay actuator for receiving said second actuating force and for undergoing sliding movement in response thereto;

a second block mounted in said housing and coupled to said third piston, wherein said sliding movement of said third piston causes a transverse sliding movement of said second block;

a second portion of said detonation train disposed in said second block;

a third portion of said detonation train disposed in said housing and coupled to said second end of said line charge array; and said second block being positioned such that said second portion and said third portion of said detonation train are adjacent and aligned with one another prior to the expiration of said second time period wherein said transverse sliding movement of said second block causes said second portion of said detonation train to move out of alignment with said third portion of said detonation train.

16. A line charge assembly as in claim 13 further comprising means coupled to said first time delay actuator and said second time delay actuator for simultaneously actuating said first time delay actuator and said second time delay actuator, wherein said first time period and said second time period commence simultaneously.

17. A line charge system for use in a shallow-water obstruction clearing operation, comprising;

a plurality of line charge assemblies, each of said plurality of line charge assemblies comprising a propulsion unit capable of flight through the air;

a line charge array defined by a plurality of line charges successively coupled to one another by a line capable of transferring detonation energy therealong successively to each of said plurality of line charges, said line charge array having a first end coupled to said propulsion unit and having a second end;

an air-safed water-armed fuze coupled to said second end for generating said detonation energy only when in water; and an explosive diode in line with said line between said first end and said second end and positioned to limit transfer of said detonation energy in a direction of propagation defined by said second end to said first end, wherein said propulsion unit pulls said line charge array, said explosive diode and said fuze through the air to a water destination and wherein, when said plurality of said line charge assemblies are deployed side-by-side over an area, a plurality of explosive diodes from said plurality of line charge assemblies are arrayed across said area.

18. A line charge system as in claim 17 wherein said propulsion unit is a rocket.

19. A line charge system as in claim 17 wherein said air-safed water-armed fuze comprises:

first means for generating said detonation energy when first conditions exists, said first conditions defined by said fuze being underwater at the expiration of a first time period, said first time period commencing when said fuze begins to be pulled by said propulsion unit; and second means coupled between said first means and said second end for permitting transfer of said detonation energy to said second end when said first conditions exist and for preventing transfer of said detonation energy to said second end when second conditions exist, said second conditions defined by said detonation energy having not been generated at the expiration of said first time period and the expiration of a second time period, wherein said second time period is longer than said first time period.

20. A line charge system as in claim 19 wherein said first means comprises:

a housing;

a cylinder defined in said housing;

a piston slidably mounted in said cylinder wherein a chamber is defined on one side of said piston, said chamber having at least one vent communicating with a surrounding fluid environment wherein said chamber is filled with fluid from said surrounding fluid environment;

a first time delay actuator for providing a first actuating force to said piston at the expiration of said first time period wherein said piston slides in said cylinder, seals said at least one vent and acts on said fluid in said chamber; and detonation means coupled to said chamber and responsive to movement of said piston to generate said detonation energy only when said fluid is water.

21. A line charge system as in claim 20 wherein said second means comprises:

a second time delay actuator for generating a second actuating force at the expiration of said second time period; and detonation coupling means coupled between said detonation means and said second end for permitting transfer of said detonation energy to said second end when said first conditions exist, said detonation coupling means coupled to said second time delay actuator and responsive to said second actuating force to prevent transfer of said detonation energy to said second end when said second conditions exist.

22. A line charge system as in claim 21 wherein said detonation means comprises:

a second piston mounted in said housing for sliding movement therein, said second piston having a piston face exposed to said chamber wherein said second piston undergoes sliding movement when said first conditions exist;

a first block slidingly mounted in said housing and coupled to said second piston, wherein said sliding movement of said second piston causes a transverse sliding movement of said first block;

a first portion of a detonation train disposed in said first block; and a firing pin mounted in said housing for striking said first portion of said detonation train when said first block undergoes said transverse sliding movement, wherein said first portion of said detonation train is initiated to generate said detonation energy.

23. A line charge system as in claim 22 wherein said detonation coupling means comprises:

a third piston mounted in said housing for sliding movement therein, said third piston having a piston face coupled to said second time delay actuator for receiving said second actuating force and for undergoing sliding movement in response thereto;

a second block mounted in said housing and coupled to said third piston, wherein said sliding movement of said third piston causes a transverse sliding movement of said second block;

a second portion of said detonation train disposed in said second block;

a third portion of said detonation train disposed in said housing and coupled to said second end of said line charge array; and said second block being positioned such that said second portion and said third portion of said detonation train are adjacent and aligned with one another prior to the expiration of said second time period wherein said transverse sliding movement of said second block causes said second portion of said detonation train to move out of alignment with said third portion of said detonation train.

24. A line charge assembly as in claim 21 further comprising means coupled to said first time delay actuator and said second time delay actuator for simultaneously actuating said first time delay actuator and said second time delay actuator, wherein said first time period and said second time period commence simultaneously.

* * * * *